US012716323B2

(12) United States Patent
Budde et al.

(10) Patent No.: US 12,716,323 B2
(45) Date of Patent: Aug. 25, 2026

(54) SUB-SURFACE RELEASE PLUG WITH PRESSURE BYPASS

(71) Applicant: Weatherford Technology Holdings, LLC, Houston, TX (US)

(72) Inventors: Marcel Budde, Vlaardingen (NL); Mark Baas, Vlaardingen (NL); Carlo Mak, Vlaardingen (NL)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/984,857

(22) Filed: Dec. 17, 2024

(65) Prior Publication Data

US 2026/0168349 A1 Jun. 18, 2026

Related U.S. Application Data

(60) Provisional application No. 63/733,527, filed on Dec. 13, 2024.

(51) Int. Cl.

| | |
|---|---|
| ***E21B 33/16*** | (2006.01) |
| ***E21B 23/04*** | (2006.01) |
| ***E21B 33/13*** | (2006.01) |
| ***E21B 33/14*** | (2006.01) |
| ***E21B 34/10*** | (2006.01) |
| ***E21B 37/10*** | (2006.01) |

(52) U.S. Cl.

CPC ..... *E21B 33/16* (2013.01); *E21B 23/0413* (2020.05); *E21B 34/10* (2013.01); *E21B 37/10* (2013.01); *E21B 33/13* (2013.01); *E21B 33/14* (2013.01)

(58) Field of Classification Search

CPC ..... E21B 33/16; E21B 23/0413; E21B 34/10; E21B 37/10; E21B 33/13; E21B 33/14

See application file for complete search history.

(56) References Cited

U.S. PATENT DOCUMENTS

| | | | | |
|---|---|---|---|---|
| 4,671,358 | A * | 6/1987 | Lindsey, Jr. | E21B 34/14 166/291 |
| 5,020,597 | A * | 6/1991 | Braddick | E21B 33/165 166/291 |
| 6,318,472 | B1 * | 11/2001 | Rogers | E21B 33/16 166/212 |
| 6,419,015 | B1 * | 7/2002 | Budde | E21B 33/05 166/70 |
| 6,527,057 | B2 | 3/2003 | Fraser, III et al. | |
| 7,143,831 | B2 * | 12/2006 | Budde | E21B 34/14 166/381 |
| 9,080,422 | B2 | 7/2015 | Melenyzer | |
| 10,221,638 | B2 | 3/2019 | Turley et al. | |
| 11,293,253 | B2 | 4/2022 | Santoso et al. | |
| 11,613,959 | B1 * | 3/2023 | McFarlin | E21B 34/142 166/386 |
| 2013/0092375 | A1 * | 4/2013 | Melenyzer | E21B 43/261 166/291 |

(Continued)

*Primary Examiner* — Neel Girish Patel

(74) *Attorney, Agent, or Firm* — Peter V. Schroeder; Booth Albanesi Schroeder PLLC

(57) ABSTRACT

A wiper plug assembly has a bypass passageway to allow pressure equalization between the wellbore below the plug and the annulus above the plug. The passageway has a unidirectional valve positioned to prevent fluid flow downhole while allowing fluid flow uphole.

20 Claims, 7 Drawing Sheets

(56) References Cited

U.S. PATENT DOCUMENTS

| | | | | |
|---|---|---|---|---|
| 2013/0112410 | A1* | 5/2013 | Szarka | E21B 33/165 166/135 |
| 2015/0083410 | A1 | 3/2015 | Steele | |
| 2015/0252650 | A1* | 9/2015 | Gaspard | E21B 17/00 166/153 |
| 2018/0135378 | A1* | 5/2018 | Budde | E21B 23/04 |
| 2018/0142528 | A1 | 5/2018 | George et al. | |
| 2022/0154552 | A1* | 5/2022 | Ross | E21B 34/106 |

* cited by examiner

SUB-SURFACE RELEASE PLUG WITH PRESSURE BYPASS

CROSS-REFERENCE TO RELATED APPLICATIONS

This application is a U.S. Non-Provisional Application claiming priority to the U.S. Provisional Application No. 63/733,527, filed Dec. 13, 2024, which is incorporated herein in its entirety for all purposes.

TECHNICAL FIELD

This disclosure relates generally to releasable subsurface plugs for use in subterranean wellbores, and more particularly, to subsurface release plugs with hydraulic pressure balancing across the plug.

BACKGROUND

After drilling a wellbore through a subterranean formation, it is typical to line the wellbore by inserting a string of tubulars, namely casing or liners, into the wellbore. At least a portion of the annulus between the wellbore and tubular is filled with cement by a cementing operation. Typically, a cementing operation involves the pumping of a cement slurry through the tubular, out of the bottom of the tubular, and up the annulus. During the cementing operations, it is typical to use one or more wiper plugs, actuated by corresponding obturating objects, to wipe the liner.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS OF THE DISCLOSURE

Figure 1:
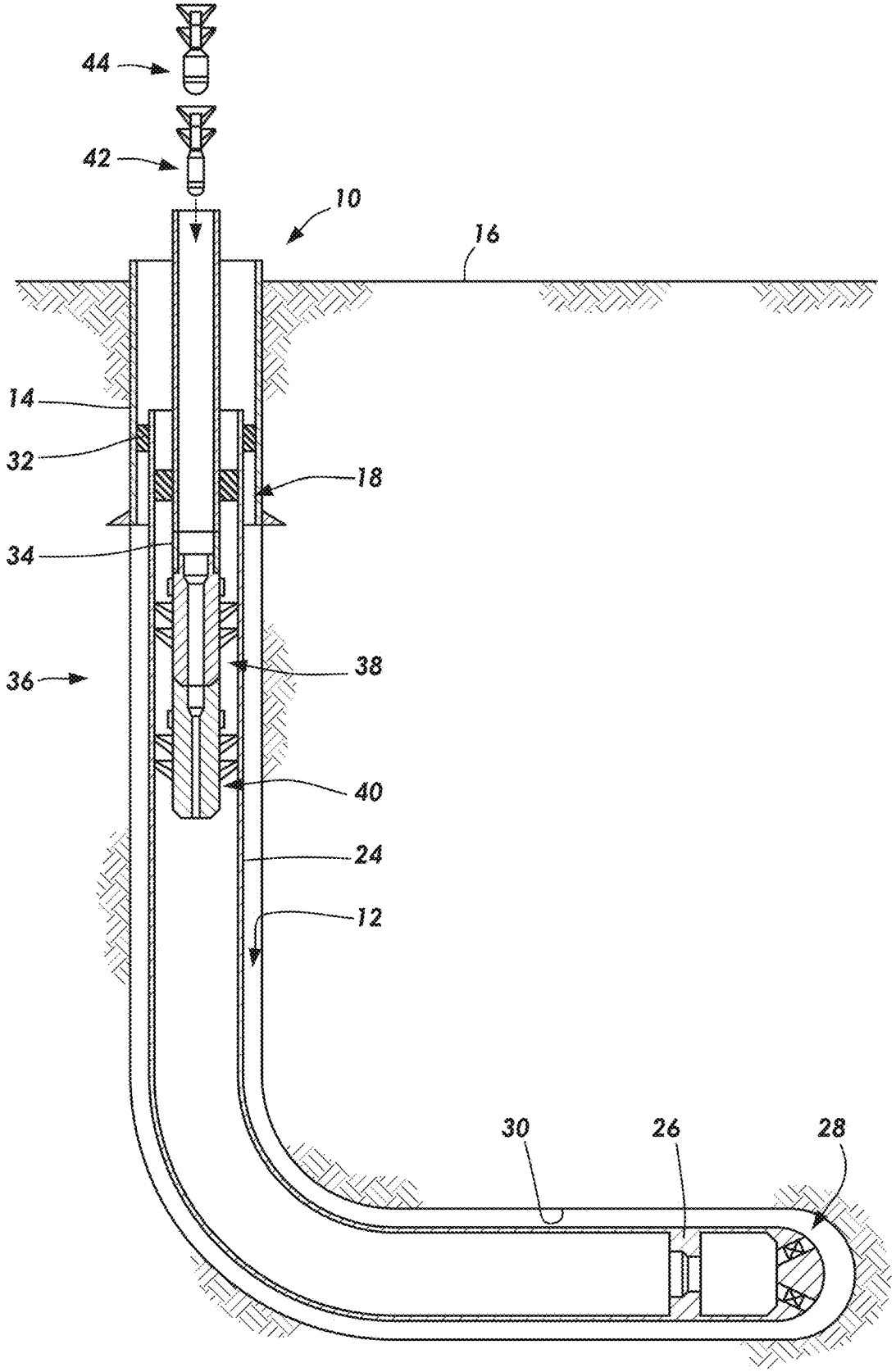
FIG. 1 is a schematic drawing of an exemplary well system having a liner system positioned in a wellbore, including a wiper plug assembly, according to aspects of the disclosure.

It is common to position a tubular string, known as a casing string, in a wellbore, hung from the wellhead at the top of the wellbore, and cement the casing string in place by a cementing operation. A similar string of tubulars hung from a location within the wellbore below the wellhead is typically referred to as a liner. The disclosures apply to both casing, liners, and other tubulars positioned in a wellbore, as those of skill in the art will recognize. While the discussion will focus on liner assemblies, the cementing processes can be practiced in casing and liner installation.

A liner is deployed to a desired depth in the wellbore using a workstring and suspended from a previously-installed casing using a liner hanger. The workstring often includes a liner assembly, a liner hanger, a setting tool, one or more wiper plugs, and a float collar or similar tool at the bottom of the string. The wiper plugs are positioned in the workstring, typically below the liner hanger and positioned to move, when released, downhole along the liner assembly, wiping the liner as it passes through the liner.

The setting tool sets the liner hanger against the previously installed casing, such as by radially expanding slips engaging the casing. The setting tool is typically operated by applying hydraulic pressure within the wellbore, such as by increasing pressure after pumping an obturating object through the workstring onto a seat below or in the setting tool. After setting, in some cases, pressure is increased to release the obturating object and the obturating object seat used to set the hanger. After actuating the liner hanger, the liner is cemented in place by pumping a cement slurry down the liner, out of the bottom of the liner, and into the annulus between the liner and the wellbore.

The term "obturating object" is used herein to include darts, drop balls, caged balls, and the like which are used to block flow through a tubular, typically by seating on a seat designed for the purpose. The obturating object can be lowered, dropped, pumped or otherwise moved in the wellbore to the cooperating seat, as is known int the art.

The wiper plugs are used to segregate cement slurry from other drilling fluids while the cement slurry travels down the casing or liner, to wipe the liner, cleaning it of excess cement or the like, and, once positioned at the bottom of the workstring, can be used to plug the liner for performing a pressure test. In a liner cementing operation, obturating objects may be used to segregate the cement from other fluids while or after the cement slurry travels down the workstring.

Obturating objects are used to selectively release each wiper plug from attachment to the workstring, allowing the wiper plug and seated obturating object to move down the liner. An obturating object picks up a corresponding wiper plug installed in an upper portion of the liner, below the liner hanger. Sometimes, a single wiper plug is used, where, for example, the wiper plug segregates the cement from fluid pumped after the cement to move the cement out of the bottom of the liner and into the annulus between the liner and the inner surface of the wellbore.

Often, multiple wiper plugs and corresponding obturating objects are used sequentially during the cementing operation. For example, a top plug and bottom plug can be positioned in the liner, below the liner hanger. A first obturating object is used to release the bottom plug, which is then pumped down the liner. The bottom plug, for example, can be used to wipe excess cement from the liner. The bottom plug is moved, typically, to the bottom of the wellbore and seated, for example, on a float collar or the like positioned at the bottom of the liner string. At a later time, the top plug is released from its connection to the liner by a second obturating object. The top plug and its corresponding obturating object are likewise pumped downhole, wiping the liner. The top plug can be seated at or near the bottom of the liner, for example, on a seat defined in the top of the bottom plug. The plugs, seated at the bottom of the liner can be used to perform, for example, pressure tests on the cemented liner assembly.

A wiper plug typically has an elastomeric body mounted on a mandrel and elastomeric external fins that bear against the liner. The fins wipe muds, solids, cement, and other accumulated debris off the wall of the liner. The elastomer material usually has a hardness that provides for structural robustness, such as for wiping of the liner, and resistance to abrasion, yet is sufficiently malleable to be deformed to provide an effective seal against the liner surface.

Although the fins seal against the liner, it is understood that the seal need not be perfect and some fluids may pass between the fins and liner, moving past the wiper plug. Generally, the less effective the seal between fins and liner, the less effective the wiper is at clearing the liner. However, an effective seal between wiper plug and liner can create problems when running the workstring, including the wiper plugs, into the wellbore. As the workstring is lowered into the wellbore, the wiper plugs seal fluid from passing through the annulus between plug and casing. This can create a substantial pressure differential above and below the plugs, make lowering the workstring difficult, requiring excessive force to move the string, reduce the ability to maneuver the workstring quickly through the wellbore, and can lead to premature setting of workstring tools which rely on hydrostatic pressure for actuation.

In the embodiments seen herein, the pressure from below the plug acts across a relatively large cross-sectional surface area of the plug assembly. However, uphole from the plug is a top plug dart receiver assembly which must carry the same forces but has a relatively smaller outer diameter and cross-sectional area. The smaller cross-sectional area requires a higher pressure on the top plug dart receiver to push the top plug from the liner assembly. These high pressures can prematurely actuate other hydraulically actuated tools in the workstring, such as the liner hanger.

The disclosed embodiments provide a wiper plug having a pressure bypass passageway, allowing pressure to bypass the plug from below to above the plug. A unidirectional valve is positioned in the bypass passageway to allow fluid passage uphole but not downhole past the plug.

Referring to FIG. 1, a well system 10 includes a wellbore 12 that is partially lined by casing 14 extending from the surface 16. The well system 10 is greatly simplified for purposes of discussion. A typical workstring will have other or different components than those shown. For example, a well system 10 can include packers, valves, joints, setting tools, engagement tools, additional plugs, wipers, and other tools as is known in the art. The wellbore is shown as horizontal, however the wellbore can be vertical, horizontal, deviated, etc., as is known in the art.

A workstring 18 is positioned in the wellbore 12 and includes multiple components, such as a liner 24, landing collar 26, float shoe 28, anchoring component 32, setting tool, a release component 34, and a wiper plug assembly 36. The liner 24 is seen partially deployed into an uncased, open hole section 30 of the wellbore 12. An anchoring component 32 anchors the liner hanger system in the well by grippingly engaging the casing 14. The anchoring component may be a packer, for example, for engaging the casing and supporting the weight of the liner hanger system.

A wiper plug assembly 36 includes a top wiper plug assembly 38 and a bottom wiper plug assembly 40. The top wiper plug assembly 38 is releasably connected to the workstring at release component 34.

A first obturating object 42 is seen for cooperation with the bottom wiper plug assembly 40. The first obturating plug is dropped or flowed downhole, into contact with the bottom wiper plug assembly. The first obturating object 42 seats on the bottom wiper plug assembly 40, or a release mechanism associated therewith, and acts to release the bottom wiper plug assembly 40 from the workstring. The bottom wiper plug assembly 40 and first obturating object 42 then move downhole to land, for example, on the landing collar 26, as seen in FIG. 2.

Similarly, a second obturating object 44 cooperates with the top wiper plug assembly 38. The second obturating object is sent downhole, into contact with the top wiper plug assembly. The second obturating object 44 seats on the top wiper plug assembly, or a release mechanism associated therewith, and acts to release the top wiper plug assembly 38 from the workstring. The top wiper plug assembly 38 then moves downhole to land, for example, on the previously released bottom wiper plug assembly 40, as seen in FIG. 3.

Figure 2:
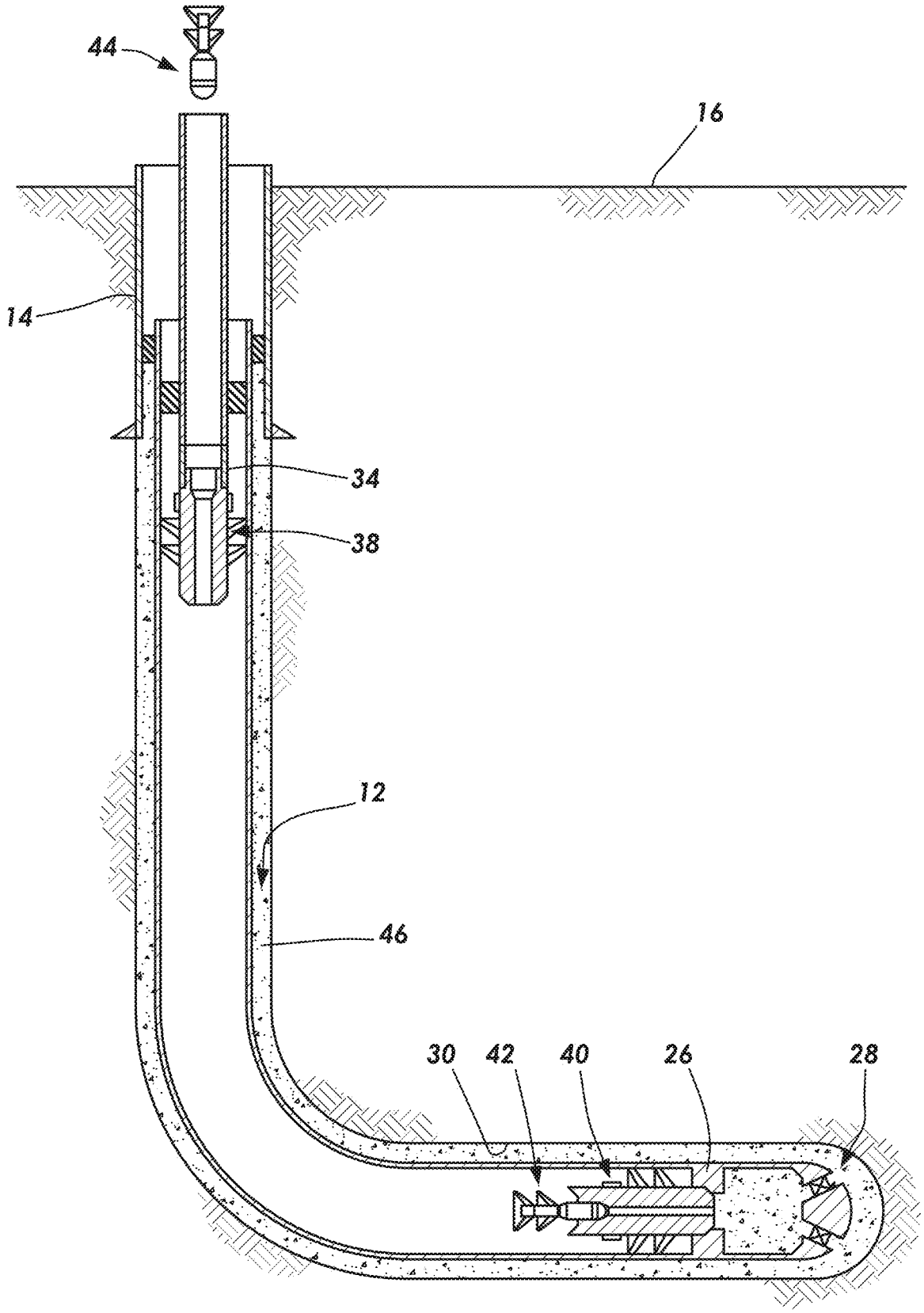
FIG. 2 is the schematic of FIG. 1 with a bottom wiper plug released from the liner assembly according to aspects of the disclosure.
Figure 3:
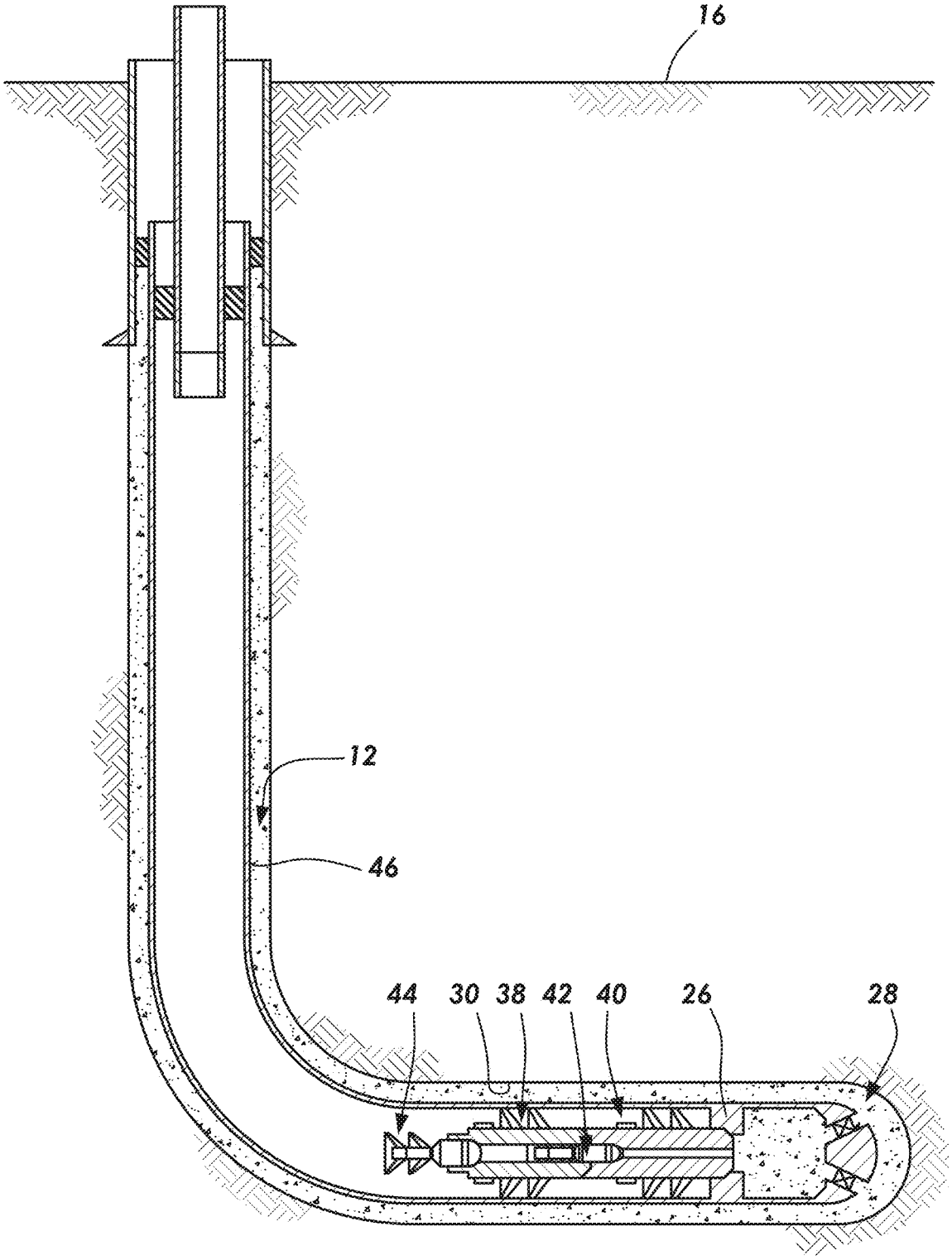
FIG. 3 is the schematic of FIG. 2 with a top wiper plug released from the liner assembly according to aspects of the disclosure

FIGS. 2 and 3 show the system after a cementing operation for purposes of discussion. A drilling fluid can be used initially in the wellbore, with the cementing operation following. The bottom wiper plug assembly can, for example, be used to separate the drilling fluid from the cement fluid. In such a case, the bottom plug assembly 40 is deployed after the drilling fluid and before the cement. The first obturating object 42 is pumped down, seated on the bottom wiper plug assembly, and, in response to hydraulic pressure applied from the surface, releases the bottom wiper plug from the top wiper plug assembly.

The bottom wiper plug assembly and first obturating object 42 are pumped to the bottom of the liner and into contact with, for example, the landing collar. The bottom wiper plug assembly often has a blocked flow path, for example, a port with a rupturable membrane, which is opened upon positioning of the bottom plug at the landing collar. Cement 46 is then deployed above the bottom plug assembly through the liner 24 into the wellbore 12. Cement 24 is pumped out the bottom of the liner, through the float shoe 28, and upwards into the annulus between the liner and the wellbore. The float shoe 28 may include valves, which may be unidirectional valves, such as check or poppet valves, and which allow the cement to travel from the interior to the exterior of the liner hanger system 14 but not upwards into the liner.

After the desired amount of cement is deployed, the second obturating object 44 is pumped down through the liner hanger and onto the top wiper plug assembly 38. The top wiper plug assembly can, for example, be used to separate the cement from a later-deployed displacement fluid. Hydraulic pressure causes the second obturating object to release the top wiper plug assembly from the liner. The top wiper plug assembly and second obturating object are pumped down to the lower end of the liner to seat, for example, on the bottom wiper plug assembly.

In some embodiments, a pressure test is run on the liner after the top wiper plug assembly and second obturating object are displaced to the bottom of the liner.

It is understood that the above description of a cementing operation is exemplary only. A two (or more) plug system can be used in a liner or casing in other operations, as is understood by those of skill in the art.

FIGS. 4-9 are cross-sectional side views of an exemplary top and bottom plug assembly according to aspects of the invention, generally shown in sequential order of operation.

Figure 4:
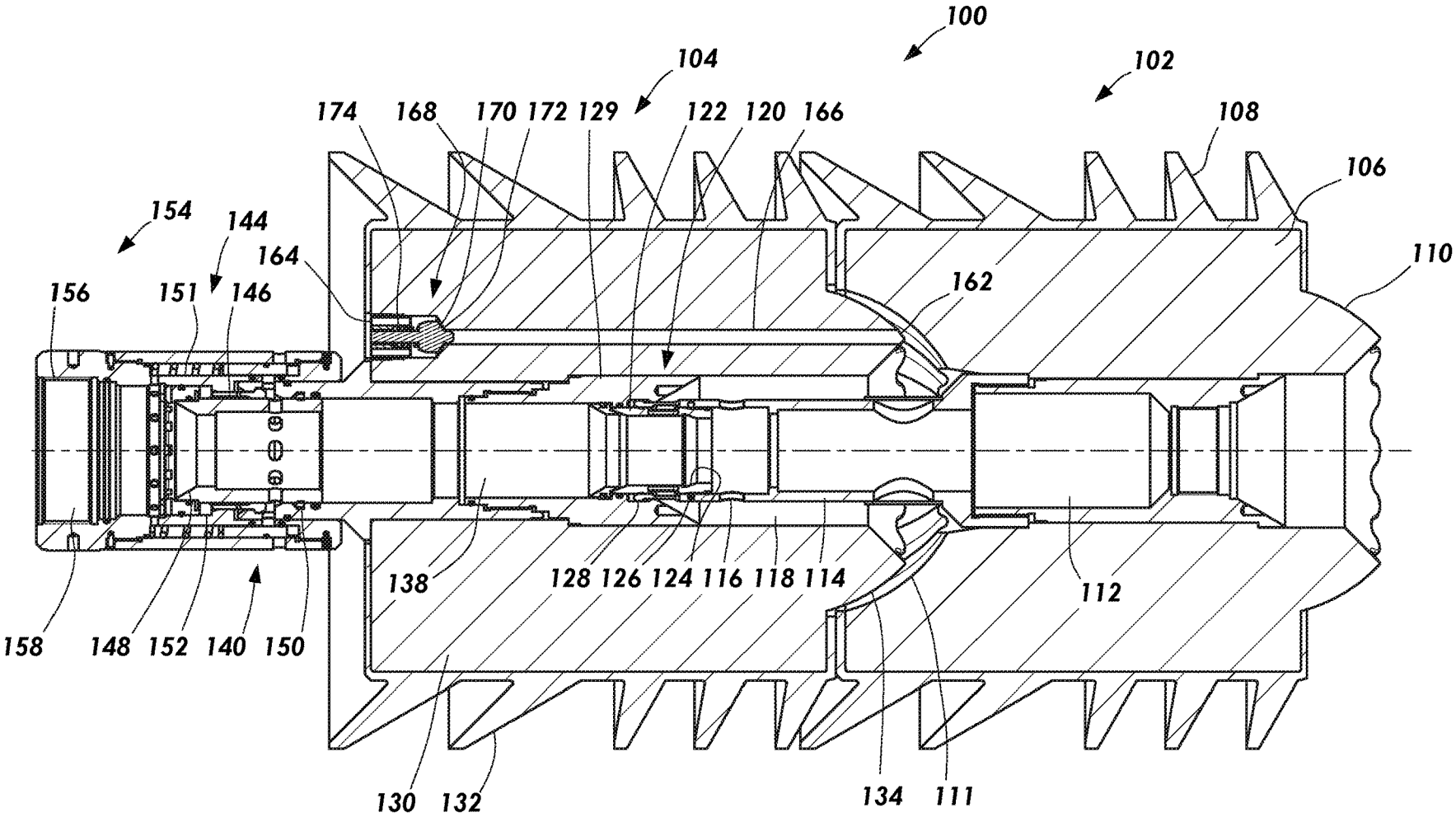
FIG. 4 is a cross-sectional view of exemplary top and bottom wiper plug assemblies attached to one another and with the unidirectional valve assembly in a closed position, according to aspects of the disclosure.
Figure 5:
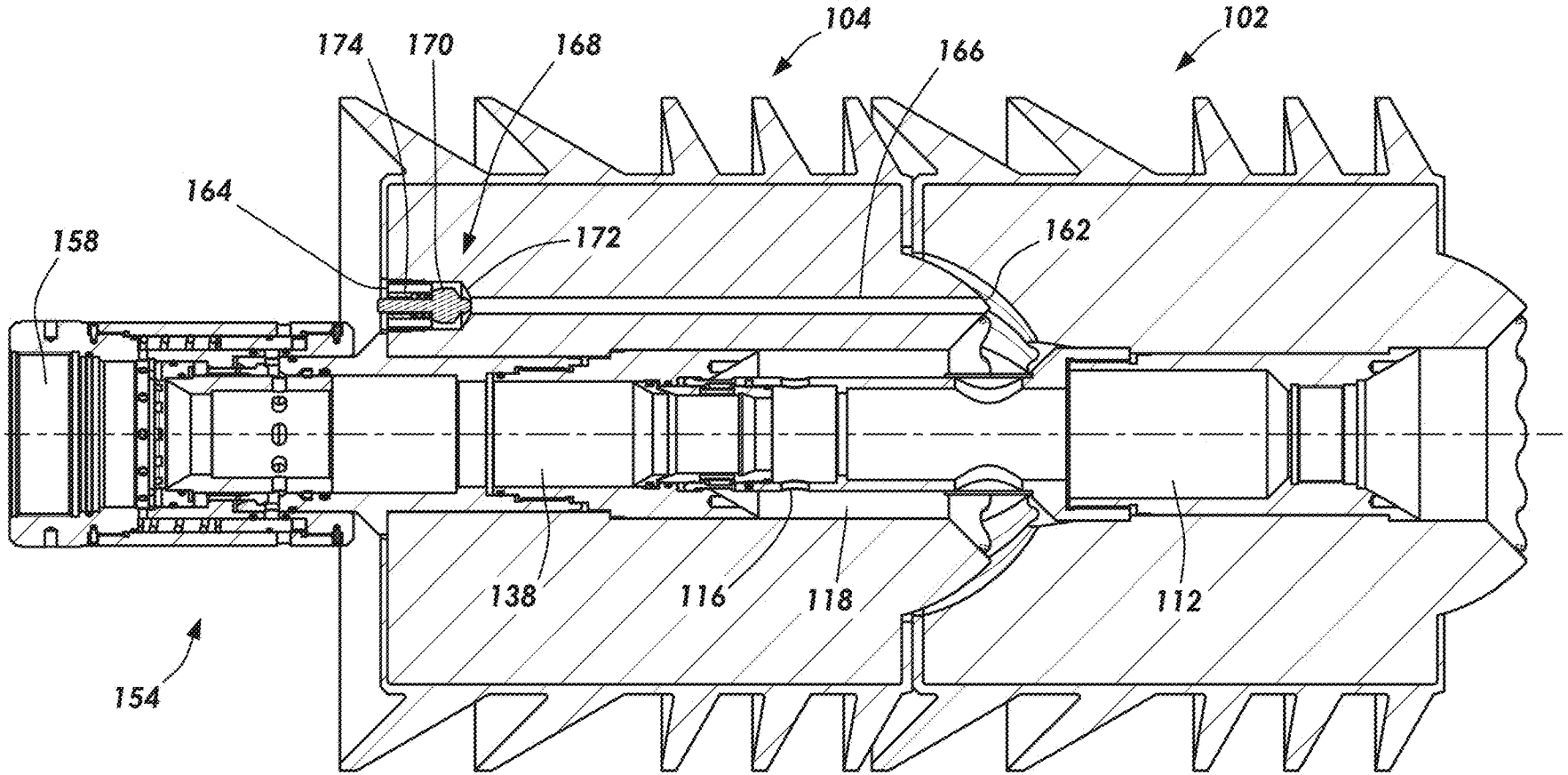
FIG. 5 is a view of the disclosure of FIG. 4 with the unidirectional valve of the top wiper plug assembly in an open position.
Figure 6:
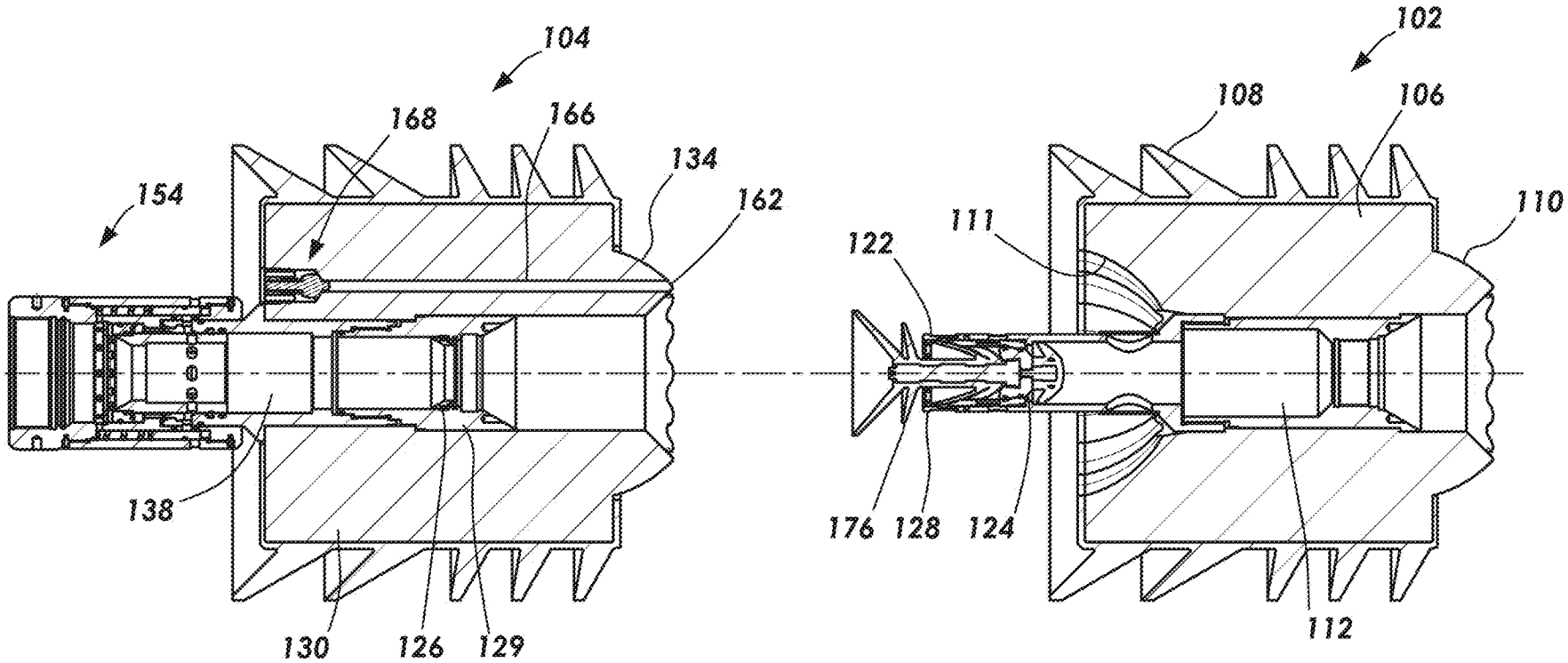
FIG. 6 is a cross-sectional view according to FIG. 5, with a first obturating object seated on a released bottom wiper plug assembly according to aspects of the disclosure.
Figure 7:
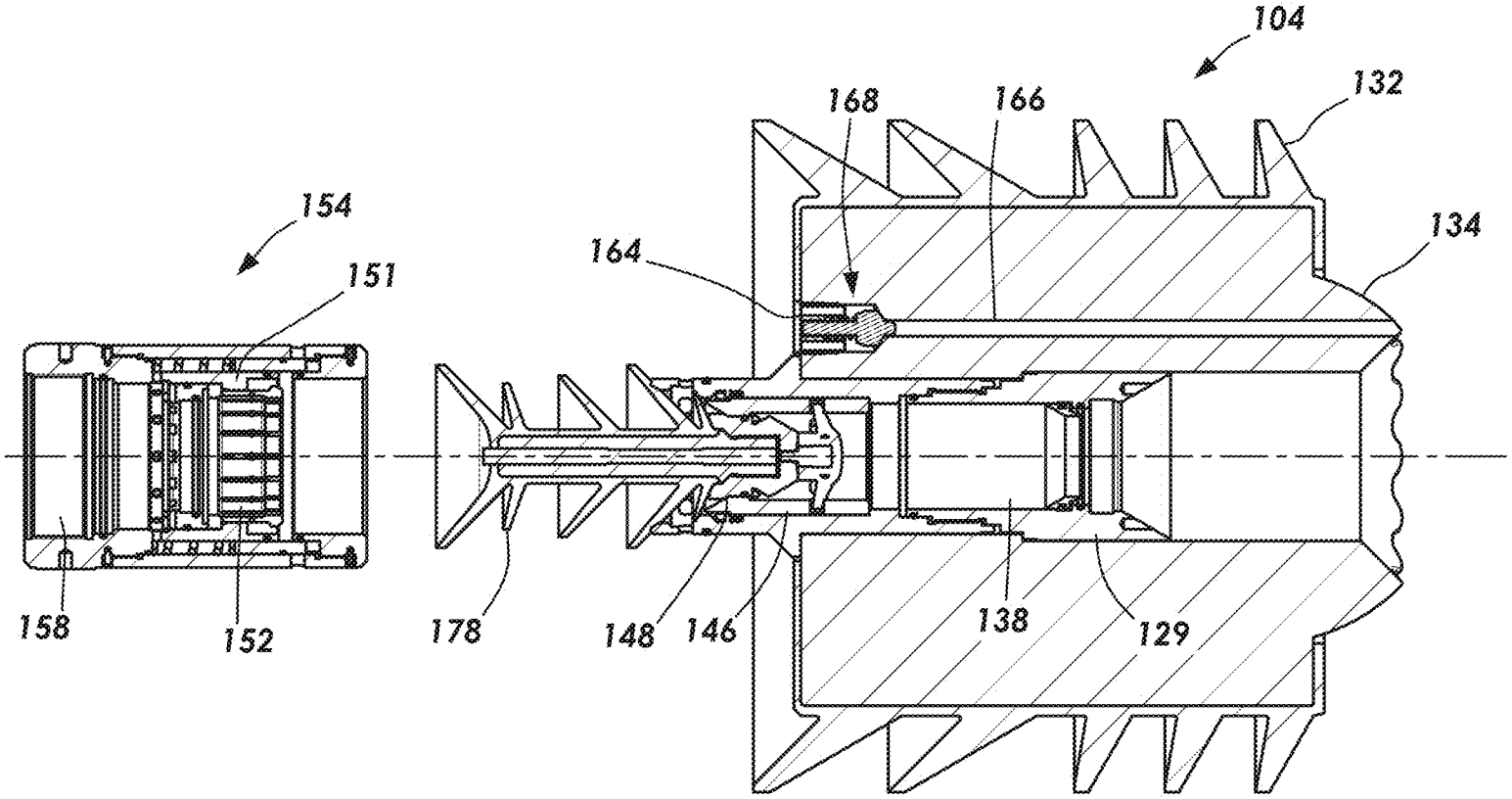
FIG. 7 is a cross-sectional view of an exemplary top wiper plug assembly with a second obturating object seated thereon and the top wiper plug released from the release component of the liner assembly according to aspects of the disclosure.

These Figures are discussed together with like parts having like numbers throughout, in which FIG. 4 is a cross-sectional view of exemplary top and bottom wiper plug assemblies attached to one another and with the unidirectional valve assembly in a closed position, according to aspects of the disclosure. FIG. 5 is a view of the disclosure of FIG. 4 with the unidirectional valve in an open position. FIG. 6 is a cross-sectional view according to FIG. 5, with a first obturating object seated on a released bottom wiper plug assembly according to aspects of the disclosure. FIG. 7 is a cross-sectional view of an exemplary top wiper plug assembly with a second obturating object seated thereon and the top wiper plug released from the release component of the liner assembly according to aspects of the disclosure.

An exemplary wiper plug assembly 100 includes a bottom wiper plug assembly 102 and a top wiper plug assembly 104. The assembly is attachable to a workstring by, for example, a release component 154 which attaches, such as at connection 156 to the workstring. In FIG. 4, the assembly is seen in an initial, run-in position, with the bypass passageway 166 closed to fluid flow by unidirectional valve assembly 168 which is in the closed position.

The bottom wiper plug assembly 102 has a tool body 106, sometimes referred to as a mandrel, supporting a plurality of wiper fins 108. The wiper fins 108 extend radially outward from the body 106 and contact the interior wall of the liner (or casing) as the plugs are moved through the liner. The fins are operable to wipe, clean, and remove cement and other debris from the liner wall. While the fins are flexible to some degree, the stiffer the fins, the better they are at wiping the liner.

The bottom wiper plug assembly 102 includes a lower profile 110. In the exemplary embodiment shown, the lower profile 110 is generally frustoconical, although other profiles can be used. The lower profile cooperates with an upper profile of a downhole component, such as a seat on a landing collar, for example. When the bottom wiper plug assembly is released from the liner, pumped down the liner, and moved into contact with the landing collar, the lower profile 110 operates to insure a proper seating. Similarly, the bottom wiper plug assembly 102 has an upper profile 111 with a similar purpose, namely, for cooperating with the matching lower profile 134 of the top wiper plug assembly 104. In their initial, run-in position in FIG. 1, the matching profiles cooperate as shown.

The bottom wiper plug assembly 102 defines a longitudinal throughbore 112 running the length of the bottom wiper plug assembly. The throughbore can be defined by the tool body 106 itself, or other tool parts, such as inserts in the bore, such as a receiver assembly. A receiver assembly 114 is positioned in the bottom wiper plug assembly 102 for receiving an obturating object, as will be described. The receiver assembly 114 includes radial ports 116, allowing fluid flow from the throughbore 112 to the annular chamber 118 defined between the top and bottom wiper plug assemblies.

The bottom wiper plug assembly 102 is releasably attached to the upper wiper plug assembly 104, and thence to the workstring and liner, at a release mechanism 120. The release mechanism can be of any type known in the art suitable for the purpose, such as lock rings, snap rings, shear pins, shear rings, and others. In the embodiment shown, the release mechanism 120 is a sliding sleeve release mechanism, as is also known in the art. A sliding sleeve 122 defines a seat 124 for cooperation with a pumped down obturating object, such as a dart. The sliding sleeve 122 is initially held in place by a locking mechanism 126, such as the lock ring shown. An insert 129 positioned in the top wiper plug assembly 104 cooperates with the release mechanism 120. For example, the insert can define grooves and profiles for cooperating with the lock ring and collet assembly. When an obturating object lands on the seat 124, hydraulic pressure is increased uphole from the object, thereby sliding the sleeve downward, actuating the sliding sleeve 122 and the release mechanism 120. This frees the collet assembly 128 to detach from the insert 129 of the top wiper plug assembly, freeing the bottom wiper plug assembly to move downhole.

The top wiper plug assembly 104 has a tool body 130 or mandrel, supporting a plurality of wiper fins 132. The wiper fins 132 extend radially outward from the body 130 and contact the interior wall of the liner (or casing) as the plugs are moved through the liner. The fins are operable to wipe, clean, and remove cement and other debris from the liner wall.

The top wiper plug assembly 104 includes a lower profile 134. In the exemplary embodiment shown, the lower profile 134 is generally frustoconical, although other profiles can be used. The lower profile cooperates with an upper profile of the bottom wiper plug assembly as explained above. When the top wiper plug assembly is released from the liner, pumped down the liner, and moved into contact with the previously released and pumped-down bottom wiper plug assembly 102, the lower profile 134 operates to insure a proper seating on the bottom wiper plug assembly.

The top wiper plug assembly 104 defines a longitudinal throughbore 138 running the length of the top wiper plug assembly. The throughbore can be defined by the tool body 130 itself, or other tool parts, such as inserts in the bore, such as a receiver assembly. A receiver assembly 140 is positioned in the top wiper plug assembly 104 for receiving an obturating object, as will be described.

The top wiper plug assembly 104 is releasably attached to the upper workstring and liner, at a release mechanism 144. The release mechanism can be of any type known in the art suitable for the purpose, such as lock rings, snap rings, shear pins, shear rings, and others. In the embodiment shown, the release mechanism 144 is a sliding sleeve release mechanism, as is also known in the art. A sliding sleeve 146 defines a seat 148 for cooperation with a pumped down obturating object, such as a dart. The sliding sleeve 146 is initially held in place by a locking mechanism 150, such as the lock ring shown. An insert 151 positioned in the release component 154 cooperates with the release mechanism 144. For example, the insert can define grooves and profiles for cooperating with the lock ring. When an obturating object lands on the seat 148, hydraulic pressure is increased uphole from the object, thereby sliding the sleeve downward, actuating the sliding sleeve 146 and the release mechanism 144. This frees the collet assembly 152 to detach the insert 151 from the top wiper plug assembly, freeing the top wiper plug assembly to move downhole.

The release component 154 seen in the exemplary embodiment is one way to releasably connect the top wiper plug assembly 104 to the workstring. The release component shown is actually a pressure equalizing component, allowing pressure back into the plug system should pressure below the plug system drop. The equalizing component is not described in detail. The release component defines a throughbore 158 and has a connection 156 for assembling with a workstring component uphole from the release assembly. The throughbores 112, 138, and 158 are fluidly connected, as shown.

The top wiper plug assembly 104 includes a bypass assembly 160. The bypass assembly 160 includes a passageway 166 from an inlet 162 to an outlet 164. The inlet 162 is in fluid communication with the annular chamber 118 formed between the top and bottom wiper plug assemblies. The outlet 164 is formed in the upper end of the top wiper plug body and fluidly communicates with the annulus formed between the workstring and the liner.

The bypass assembly 160 includes a unidirectional valve assembly 168 having a reciprocating valve member 170 which moves from a closed position, seen in FIG. 4, wherein the valve member is seated on a seat 172, to an open position, seen in FIG. 5, wherein the valve is open and fluid can move past the valve assembly and through the bypass passageway. The valve member 170 is biased towards the closed position by a biasing mechanism 174, such as a spring. The unidirectional valve assembly is shown as a poppet type valve, although other valve types can be used, as those of skill in the art will understand. The biasing mechanism can be any known in the art suitable for use in the system, such as coil springs, leaf springs, stacked springs, elastomeric material, etc.

Upon make-up of the wiper plug assembly at the surface, pressure is trapped in the annular chamber, namely, at one atmosphere of pressure. The chamber is sealed by the top plug fins. The fins have a strong wiping and sealing property which generates high pressure from below the assembly. The pressure, in turn, generates an upward force across the bottom wiper plug which must be overcome by the smaller out diameter top plug dart receiver. The high pressures in the running tool can accidentally prematurely release or set a tool, such as the liner hanger. The bypass assembly solves this issue.

FIG. 5 shows the wiper plug assembly 100, just as in FIG. 4, but with the bypass assembly 160 open to fluid flow therethrough. The valve member 170 has been forced off its seat 172 by fluid pressure from the annular chamber 118 and fluid can now flow from the annular chamber, through the inlet 162, the passageway 166, past the valve assembly 168, out the outlet 184, and into the annular space between the workstring and the liner. The pressure in the annular chamber is thus decreased to a selected pressure, at which point the valve assembly is closed by the biasing mechanism.

In FIG. 6, a first obturating object 176, namely a dart, has been pumped down the wellbore and into contact with the release mechanism 120 of the bottom wiper plug assembly 102. The object 176 seats on seat 124 in the sliding sleeve 122. Pressure is increased above the object, forcing the object and the sliding sleeve downward. The force overcomes the locking mechanism 126, such as the lock ring shown. In some embodiments, the first obturating object latches onto the bottom wiper plug assembly. The collet assembly 128 releases from the insert 129, and the object 176 and bottom plug assembly 102 are released from the top plug assembly, and thus, released from the liner assembly. The bottom wiper plug assembly 102 and object 176 are then pumped down the liner.

In some embodiments, a drilling fluid is pumped down the liner assembly prior to releasing the bottom wiper plug assembly. The bottom wiper plug assembly is then released and pumped down the liner with cement behind it. That is, the bottom wiper plug assembly is used to separate the drilling fluid and cement. The bottom wiper plug assembly lands on a seat positioned in the foot of the liner for that purpose, such as a landing collar. Cement is then flowed down the liner, out the bottom of the liner, such as through the float shoe, and back up the annulus between liner and wellbore. This description is simplified. The process also involves opening of ports and other acts, as is known in the art.

In FIG. 7, a second obturating object 178, namely a second dart, has been pumped down the wellbore and into contact with the release mechanism 144 of the top wiper plug assembly 104. The second object 178 seats on seat 148 in the sliding sleeve 146. Pressure is increased above the seated second object, forcing the second object and the sliding sleeve downward. The force overcomes the locking mechanism 150, such as the lock ring shown. In some embodiments, the second obturating object latches onto the top wiper plug assembly. The collet assembly 152 releases, and the second object 178 and top wiper plug assembly 104 are released from the release component 154, and thus, released from the liner assembly. The top wiper plug assembly 104 and object 178 are then pumped down the liner.

In some embodiments, cement is pumped down the liner assembly prior to releasing the top wiper plug assembly. The top wiper plug assembly is then released and pumped down the liner with a different fluid behind it, such as displacement fluid. That is, the top wiper plug assembly is used to separate the cement and displacement fluid. The top wiper plug assembly can land on a seat positioned in near the foot of the liner for that purpose, such as on the upper profile of the bottom wiper plug assembly.

The terms "above" and "below, and "behind" and "in front," are used herein without respect to whether the wellbore is vertical or horizontal. Similarly, the terms "uphole," "downhole," and the like are used without respect to whether the wellbore is vertical or horizontal. For example, a fluid, tool or the like, said to be above, behind, or uphole of another tool is relatively closer to the wellhead along the wellbore, or having entered the wellbore later, whether along a horizontal or vertical portion of the wellbore. Similarly, terms such "upstream" and "downstream" are used in reference to direction of fluid flow and without regard to the orientation of the wellbore. As persons of skill in the art will understand, the disclosures herein are applicable in horizontal, vertical, deviated and other wells The terms "connect," "connection," "connecting," "in connection with," and the like are used to mean, without limitation, "in direct connection with" or "in connection via one or more elements" unless a specific type of connection is indicated. The terms "couple," "coupling," "coupled," and the like are used, without limitation, to mean "directly coupled together" or "coupled together via one or more elements" unless a specific type of coupling is indicated. The terms "attach," "attached," "attachment," and the like are used to mean, without limitation, "directly attached to" or "attached to via one or more elements" unless a specific type of connection is indicated.

The embodiments disclosed above are illustrative only, as the present disclosure may be modified and practiced in different but equivalent manners apparent to those skilled in the art having the benefit of the teachings herein. It is therefore evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims. Section headings are for reference only and are non-limiting.

It is claimed:

1. A subsurface plug assembly for use in a wellbore extending through a subterranean formation, the subsurface releasable plug assembly comprising:

a bottom wiper plug assembly having:

a bottom wiper plug body defining a longitudinal throughbore, a first seat defined in the throughbore for cooperating with a first obturating object, and a plurality of bottom wiper fins extending radially from the bottom wiper plug body;

a top wiper plug assembly releasably connected to the bottom wiper plug assembly, the top wiper plug assembly having:

a top wiper plug body defining a longitudinal throughbore;

a second seat defined in the throughbore of the top wiper plug body for cooperating with a second obturating object, a plurality of top wiper fins extending radially from the top wiper plug body, an upper wellbore annulus defined between the wellbore and an exterior of the top wiper plug assembly, the upper wellbore annulus uphole from the plurality of top wiper fins, and a longitudinal bypass passageway having a unidirectional valve assembly positioned therein, the bypass passageway having an outlet formed in an upper end of the top wiper plug assembly, the outlet in fluid communication with the upper wellbore annulus; and an annular chamber defined between the top wiper plug assembly and the bottom wiper plug assembly, the annular chamber in fluid communication with the throughbore of the bottom wiper plug body and in fluid communication with an inlet of the bypass passageway; and a flow path defined for flowing fluid from the throughbore of the bottom wiper plug body through the annular chamber, then through the inlet of the bypass passageway, then through the unidirectional valve assembly, then through the outlet of the bypass passageway, and then to the upper wellbore annulus, thereby allowing fluid pressure to bypass the top wiper plug assembly from below the bottom wiper plug assembly.

2. The subsurface plug assembly of claim 1, wherein the top wiper plug assembly is releasably connectable, at an upper end, to a workstring.

3. The subsurface plug assembly of claim 1, wherein the unidirectional valve is biased against flow from the annular chamber.

4. The subsurface plug assembly of claim 3, wherein the unidirectional valve opens upon pressure increase below the bottom wiper plug during run-in of the subsurface plug assembly.

5. The subsurface plug assembly of claim 1, wherein the bottom wiper plug assembly is releasably attached to the top wiper plug assembly at a first sliding sleeve, the first seat positioned on the first sliding sleeve, the sliding sleeve cooperating with a locking mechanism positioned between the first sliding sleeve and the top wiper plug assembly body.

6. The subsurface plug assembly of claim 1, wherein the top wiper plug assembly is releasably attached to a component of the workstring at a second sliding sleeve, the second seat positioned on the second sliding sleeve, the second sliding sleeve cooperating with a locking mechanism positioned between the second sliding sleeve and the component of the workstring.

7. The subsurface plug assembly of claim 1, wherein the top wiper plug assembly includes a lower surface for cooperating with an upper surface of the bottom wiper plug assembly, the cooperating surfaces for landing the top wiper plug assembly on the bottom wiper plug assembly.

8. A method of wiping a tubular positioned in a wellbore extending through a subterranean formation, the method comprising:

running in a workstring having a liner, a top wiper plug assembly and a bottom wiper plug assembly positioned on the liner, the top wiper plug assembly and the bottom wiper plug assembly each having a least one radially extending fin for wiping a tubular positioned in the wellbore;

in response to hydraulic pressure below the workstring:

flowing wellbore fluid from a throughbore defined in the bottom wiper plug assembly into an annular chamber defined between the top wiper plug assembly and the bottom wiper plug assembly;

flowing fluid from the annular chamber through a bypass passageway defined longitudinally through the top wiper plug assembly;

opening, with the fluid flow, a unidirectional valve assembly positioned in the bypass passageway; and flowing fluid from the bypass passageway through an outlet positioned at an upper end of the top wiper plug assembly uphole from the at least one radial fin of the top wiper plug assembly and into an upper wellbore annulus defined between the exterior of the workstring and the tubular positioned in the wellbore, the upper wellbore annulus uphole from the top wiper plug assembly.

9. The method of claim 8, further comprising: moving a first obturating object down the wellbore, seating the first obturating object on a seat defined in the throughbore of the bottom wiper plug assembly, increasing hydraulic pressure above the seated first obturating object, and releasing the bottom wiper plug assembly from the liner.

10. The method of claim 9, further comprising: moving the first obturating object and the bottom wiper plug assembly downhole in the liner.

11. The method of claim 9, further comprising: moving a second obturating object down the wellbore, seating the second obturating object on a seat defined in the throughbore of the top wiper plug assembly, increasing hydraulic pressure above the seated second obturating object, and releasing the top wiper plug assembly from the liner.

12. The method of claim 11, wherein releasing the top wiper plug assembly further comprises actuating a release mechanism of the top wiper plug assembly using the second obturating object.

13. The methods of claim 12, wherein actuating the release mechanism of at least one of the bottom wiper plug assembly or top wiper plug assembly further comprises moving a sliding sleeve and in response thereto unlocking a locking mechanism.

14. The method of claim 11, further comprising moving the top wiper plug assembly and second obturating object into contact with the bottom wiper plug assembly.

15. The method of claim 9, wherein releasing the bottom wiper plug assembly further comprises actuating a release mechanism of the bottom wiper plug assembly using the first obturating object.

16. The method of claim 9, further comprising flowing cement through the liner after releasing the bottom wiper plug assembly from the liner.

17. A system for use in a wellbore extending through a subterranean formation, the system comprising:

a workstring having a liner, a liner hanger, and a wiper plug assembly;

the wiper plug assembly having a top wiper plug assembly and a bottom wiper plug assembly;

the bottom wiper plug assembly having: a bottom wiper plug body defining a longitudinal throughbore, a first seat defined in the throughbore for cooperating with a first obturating object, a plurality of bottom wiper fins extending radially from the bottom wiper plug body;

the top wiper plug assembly having: a top wiper plug body defining a longitudinal throughbore, a second seat defined in the throughbore for cooperating with a second obturating object, a plurality of top wiper fins extending radially from the top wiper plug body, and a longitudinal bypass passageway having a unidirectional valve assembly positioned therein; and the bottom wiper plug assembly releasably connected to the top wiper plug assembly, an annular chamber formed between the top wiper plug assembly and the bottom wiper plug assembly, a flow path defined for flowing fluid from the throughbore of the bottom wiper plug assembly to the annular chamber, then from the annular chamber to the bypass passageway, then through the bypass passageway to an outlet positioned at an upper end of the top wiper plug assembly uphole from the plurality of top wiper fins, then through the outlet to an upper wellbore annulus, the upper wellbore annulus defined between an exterior of the top wiper plug assembly and the wellbore and uphole from the plurality of top wiper fins.

18. The system of claim 17, wherein the top wiper plug assembly is releasably connectable, at an upper end, to a release component of the workstring.

19. The system of claim 17, wherein the unidirectional valve is biased against flow from the annular chamber.

20. The system of claim 17, wherein the bottom wiper plug assembly is releasably attached to the top wiper plug assembly at a first sliding sleeve, the first seat positioned on the first sliding sleeve, the sliding sleeve cooperating with a locking mechanism positioned between the first sliding sleeve and the top wiper plug assembly body.

* * * * *